US007557684B2

(12) United States Patent
Kurasawa

(10) Patent No.: US 7,557,684 B2
(45) Date of Patent: Jul. 7, 2009

(54) ELECTROMAGNETIC SWITCH WITH FIXED MAGNETIC CORE HAVING DISC PORTION FORMED OF STACK OF BASE AND BALANCE METAL SHEETS

(75) Inventor: Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 158 days.

(21) Appl. No.: 11/705,122

(22) Filed: Feb. 12, 2007

(65) Prior Publication Data

US 2007/0194868 A1 Aug. 23, 2007

(30) Foreign Application Priority Data

Feb. 23, 2006 (JP) ..... 2006-046976

(51) Int. Cl.
*H01F 3/00* (2006.01)
*H01F 7/08* (2006.01)

(52) U.S. Cl. ..... 335/281; 335/126; 335/135; 335/180; 335/273; 335/297; 335/127; 335/128; 335/129; 335/130; 335/131; 335/132

(58) Field of Classification Search ..... 335/126–132, 335/135, 180, 273, 281, 297
See application file for complete search history.

(56) References Cited

U.S. PATENT DOCUMENTS 2,268,718 A 1/1942 Newton
2,332,139 A 10/1943 Finnegan
3,171,064 A * 2/1965 Ruder ..... 335/297
3,207,960 A * 9/1965 MacDougal ..... 335/297
3,822,469 A 7/1974 Lazenby
4,044,322 A * 8/1977 Brown et al. ..... 335/131
5,014,027 A 5/1991 Ootsuka
5,181,002 A * 1/1993 Sugiyama ..... 335/131

(Continued)

FOREIGN PATENT DOCUMENTS

JP A 2002-524826 8/2002

OTHER PUBLICATIONS

U.S. Appl. No. 11/598,057 in the name of Mikio Tsukada, filed Nov. 13, 2006.

(Continued)

*Primary Examiner*—Lincoln Donovan
*Assistant Examiner*—Mohamad A Musleh
(74) *Attorney, Agent, or Firm*—Oliff & Berridge, PLC

(57) ABSTRACT

According to the invention, an electromagnetic switch includes a pair of fixed contacts, a movable magnetic core, a magnetic coil, and a fixed magnetic core. The movable magnetic core is configured to be moved by a magnetic attraction, thereby establishing an electrical connection between the fixed contacts. The fixed magnetic core is configured to create the magnetic attraction when the magnetic coil is energized. The fixed magnetic core has a base portion and a disc portion. The base portion is arranged to face the movable magnetic core. The disc portion is fixed to the base portion and formed of a stack of metal sheets including at least one base metal sheet and a balance metal sheet. The balance metal sheet has a thickness that is predetermined to balance a difference between a desired thickness of the disc portion and a total thickness of the at least one base metal sheet.

4 Claims, 6 Drawing Sheets

U.S. PATENT DOCUMENTS 5,252,935 A * 10/1993 Yamamoto et al. ..... 335/126
5,338,996 A 8/1994 Yamamoto
6,281,770 B1 8/2001 Quentric
6,578,689 B2 6/2003 Kawada et al.
6,798,323 B2 9/2004 Smith et al.
7,420,309 B2 * 9/2008 Wakitani et al. ..... 310/216
2007/0013255 A1 * 1/2007 Wakitani et al. ..... 310/216
2007/0188278 A1 * 8/2007 Tsukada et al. ..... 335/132

OTHER PUBLICATIONS

Chinese Office Action, State Intellectual Property Office, Beijing, P.R. China, Feb. 6, 2009.

* cited by examiner

ELECTROMAGNETIC SWITCH WITH FIXED MAGNETIC CORE HAVING DISC PORTION FORMED OF STACK OF BASE AND BALANCE METAL SHEETS

CROSS-REFERENCE TO RELATED APPLICATION

This application is based on and claims priority from Japanese Patent Application No. 2006-46976, filed on Feb. 23, 2006, the content of which is hereby incorporated by reference into this application.

BACKGROUND OF THE INVENTION

1. Technical Field of the Invention

The present invention relates generally to electromagnetic switches. More particularly, the invention relates to an electromagnetic switch for an automotive starter motor, which includes a fixed magnetic core that has a disc portion formed of a stack of base and balance metal sheets.

2. Description of the Related Art

U.S. Pat. No. 6,281,770 B1 discloses an electromagnetic switch which includes a fixed magnetic core that is made in two-part form.

More specifically, referring to FIG. 7, the fixed magnetic core has a base portion 100 and a disc portion 110 that are made separately. The base portion 100 is made to have a boss 130. The disc portion 110 is made by stacking a plurality of thin laminations 120, each of which has a center through-hole. The base and disc portions 100 and 110 are assembled together by press-fitting the boss 130 of the base portion 100 into the center through-holes of the laminations 120 that make up the disc portion 110.

In order to minimize the manufacturing cost, the laminations 120 are generally made up of standard steel laminations which are readily available from the market.

However, in such a case, all the laminations 120 have the same thickness, and thus it is difficult to set the thickness of the disc portion 110, which is the sum of thickness of the laminations 120, to a desired value. Accordingly, in design of the magnetic circuit of the switch, it is difficult to optimize the cross section of the disc portion 110.

Further, in such a case, the press-fit load for each of the laminations 120 is smaller than in the case of a disc portion that is formed of a piece of thick metal sheet. Accordingly, each of the laminations 120 can be detached from the boss 130 of the base portion 100 with a smaller force. Consequently, when the movable magnetic core collides against the fixed magnetic core during operation of the switch, the laminations 120 may be detached from the boss 130 of the based portion 100 due to a mechanical shock caused by the collision.

SUMMARY OF THE INVENTION

The present invention has been made in view of the above-mentioned problems.

It is, therefore, a primary object of the present invention to provide an electromagnetic switch which includes a fixed magnetic core having a disc portion that is formed of a stack of metal sheets with a desired thickness and thus has an optimal cross section.

According to the present invention, there is provided an electromagnetic switch which includes a pair of fixed contacts, a movable magnetic core, a magnetic coil, and a fixed magnetic core.

The movable magnetic core is configured to be moved by a magnetic attraction, thereby establishing an electrical connection between the fixed contacts.

The fixed magnetic core is configured to create the magnetic attraction when the magnetic coil is energized. The fixed magnetic core has a base portion and a disc portion. The base portion is arranged to face the movable magnetic core. The disc portion is fixed to the base portion and formed of a stack of metal sheets including at least one base metal sheet and a balance metal sheet. The balance metal sheet has a thickness that is predetermined to balance a difference between a desired thickness of the disc portion and a total thickness of the at least one base metal sheet.

With the above configuration, the thickness of the disc portion can be set to the desired thickness by setting the thickness of the balance metal sheet to the predetermined thickness that can balance the difference between the desired thickness of the disc portion and the total thickness of the at least one base metal sheet.

Consequently, the cross section of the disc portion can be optimized with the desired thickness of the disc portion.

Further, the thickness of the balance metal sheet may be different from a thickness of the base metal sheet.

In a preferred embodiment of the invention, the base portion of the fixed magnetic core has a body facing the movable magnetic core and a boss protruding from the body in an opposite direction to the movable magnetic core. Each of the metal sheets has a center through-hole in which the boss of the base portion is press-fitted. The balance metal sheet is arranged farthest from the movable magnetic core among the metal sheets. The thickness of the balance metal sheet is greater than the thickness of the base metal sheet.

With the above configuration, it is possible to reliably prevent the balance metal sheet and thus the entire disc portion from being detached from the boss of the base portion during operation of the electromagnetic switch.

In another preferred embodiment of the invention, the electromagnetic switch further includes a yoke that accommodates therein the magnetic coil and the fixed magnetic core and has formed therein an inner shoulder by which the fixed magnetic core is positioned in the yoke. Among the metal sheets, only the balance metal sheet abuts the inner shoulder of the yoke. The thickness of the balance metal sheet is less than the thickness of the base metal sheet.

With the above configuration, it is possible to secure a sufficiently large contact area between the balance metal sheet and the inner shoulder of the yoke, thereby minimizing the magneto-resistance of the magnetic circuit of the electromagnetic switch. As a result, the magnetic attraction between the fixed and movable magnetic cores can be maximized, thus making it possible to downsize the electromagnetic switch.

In yet another preferred embodiment of the invention, one of the metal sheets, which is arranged farthest from the movable magnetic core among the metal sheets, is made of steel and has, on an opposite side to the movable magnetic core, a coated surface to which an earth terminal of the magnetic coil is joined by one of welding and soldering.

With the above configuration, the earth terminal of the magnetic coil can be reliably joined to the coated surface of the steel-made balance metal sheet. At the same, since there is no need to coat all of the metal sheets, the manufacturing cost can be reduced.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
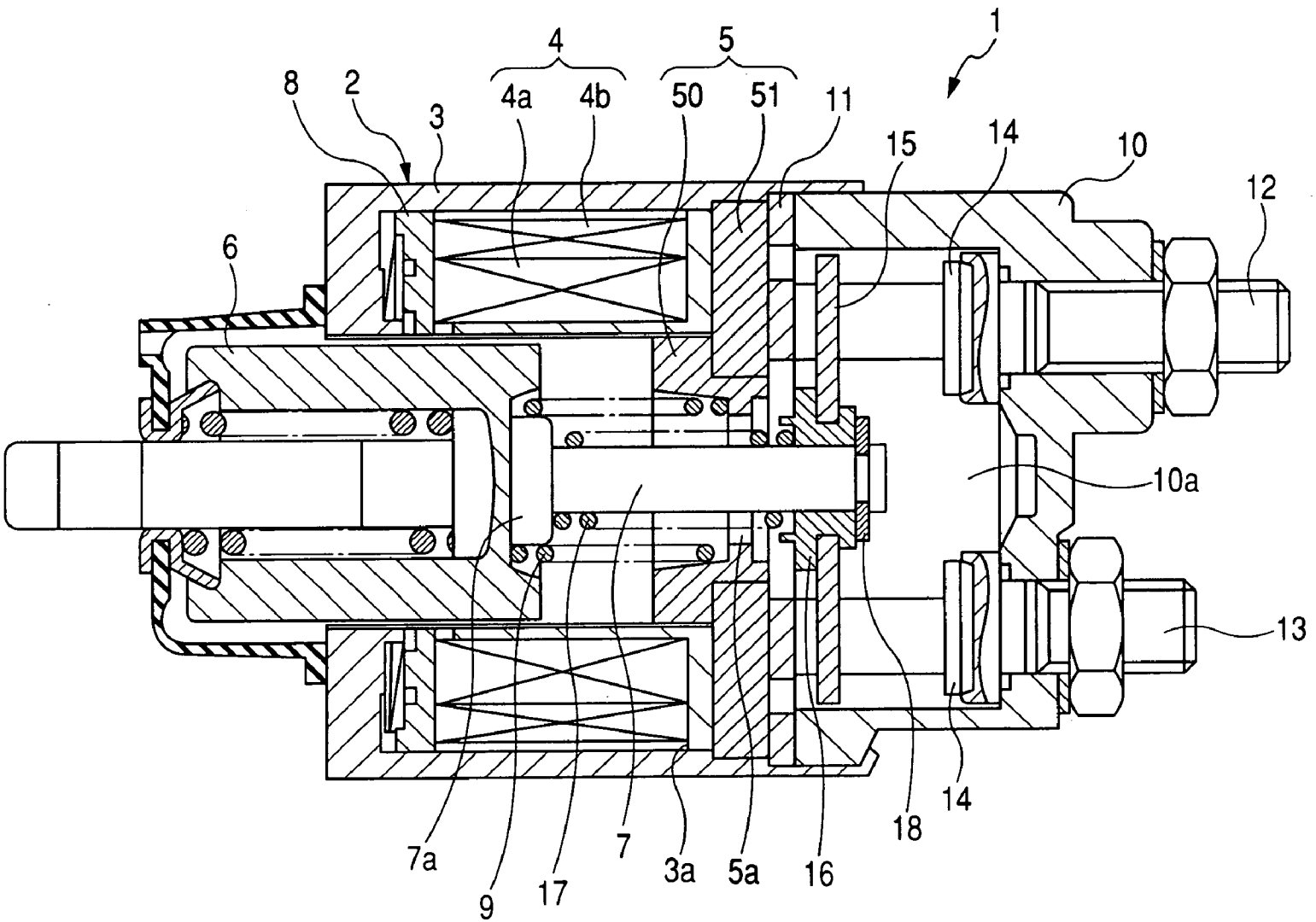
FIG. 1 is a partially cross-sectional view showing the overall configuration of an electromagnetic switch according to the first embodiment of the invention.

The preferred embodiments of the present invention will be described hereinafter with reference to FIGS. 1-5.

It should be noted that, for the sake of clarity and understanding, identical components having identical functions in different embodiments of the invention have been marked, where possible, with the same reference numerals in each of the figures.

First Embodiment

FIG. 1 shows the overall configuration of an electromagnetic switch 1 according to the first embodiment of the invention. The electromagnetic switch 1 is designed to close and open, for example, a power supply circuit of an automotive starter motor.

As shown in FIG. 1, the electromagnetic switch 1 includes a pair of fixed contacts 14 spaced away from each other, which make up the main contacts of the power supply circuit of the starter motor, a movable contact 15 working to connect and disconnect the fixed contacts 14, and a solenoid 2 working to actuate the movable contact 15 to make contact with and get away from the fixed contacts 14.

The solenoid 2 includes a cup-shaped yoke 3, a magnetic coil 4 accommodated in the yoke 3, a fixed magnetic core 5 configured to be magnetized upon energizing the magnetic coil 4, a plunger (i.e., a movable magnetic core) 6 slidably inserted in the magnetic coil 4, and a shaft 7 working to transmit motion of the plunger 6 to the movable contact 15.

The yoke 3 serves as an outer frame of the solenoid 2 to accommodate therein the fixed magnetic core 5 as well as the magnetic coil 4. The yoke 3 also works to form a magnetic circuit around the magnetic coil 4 in cooperation with the fixed magnetic core 5 and the plunger 6.

The magnetic coil 4 consists of a pull-in winding 4*a* and a hold winding 4*b*. The pull-in winding 4*a* is provided for creating a magnetic attraction to attract the plunger 6. On the other hand, the hold winding 4*b* is provided for creating a magnetic attraction for holing the attracted plunger 6 in place. The pull-in and hold windings 4*a* and 4*b* are wound around a resin-made bobbin 8 in two-layer form.

The fixed magnetic core 5 is made of a ferromagnetic material, for example, steel. The detailed configuration of the fixed magnetic core 5 is to be described latter.

The plunger 6 is disposed inside the magnetic coil 4 to face the fixed magnetic core 5 in the longitudinal direction of the electromagnetic switch 1. Between the plunger 6 and the fixed magnetic core 5, there is provided a return spring 9. The return spring 9 urges the plunger 6 in the direction away from the fixed magnetic core 5 (i.e., in the leftward direction of FIG. 1), thereby keeping a predetermined air gap between the plunger 6 and the fixed magnetic core 5.

The shaft 7 has a flange portion 7*a* at a base end thereof. The flange portion 7*a* is fixed to an end face of the plunger 6, thus making the shaft 7 movable along with the plunger 6. On the other hand, a distal end of the shaft 7 projects, through a center through-hole 5*a* of the fixed magnetic core 5, into a contact chamber 10*a*.

The contact chamber 10*a* is formed within a contact cover 10 to accommodate therein the fixed contacts 14 and the movable contact 15. The contact cover 10 is made, for example, of a resin material by molding. As seen from FIG. 1, the contact cover 10 is joined, via a rubber packing 11, to an end face of the fixed magnetic core 5 by crimping the open end of the yoke 3 inwardly.

The fixed contacts 14 are connected to the power supply circuit of the starter motor via terminal studs 12 and 13, respectively. The terminal studs 12 and 13 are fastened to the contact cover 10 and electrically connected to the positive terminal of an automotive battery (not shown) and the field winding of the starter motor (not shown), respectively.

The movable contact 15 is supported, via an insulator 16, by the shaft 7 such that the movable contact 15 is movable relative to the shaft 7 in the axial direction of the shaft 7.

A contact pressure spring 17 is arranged, around the shaft 7, between the flange portion 7*a* of the shaft 7 and the insulator 16. The contact pressure spring 17 urges the movable contact 15 as well as the insulator 16 in the direction from the base end to the distal end of the shaft 7 (i.e., in the rightward direction of FIG. 1). Moreover, a stopper (e.g., a washer) 18 is provided at the distal end of the shaft 7 to stop the movable contact 15 from being detached from the shaft 7.

Figure 2:
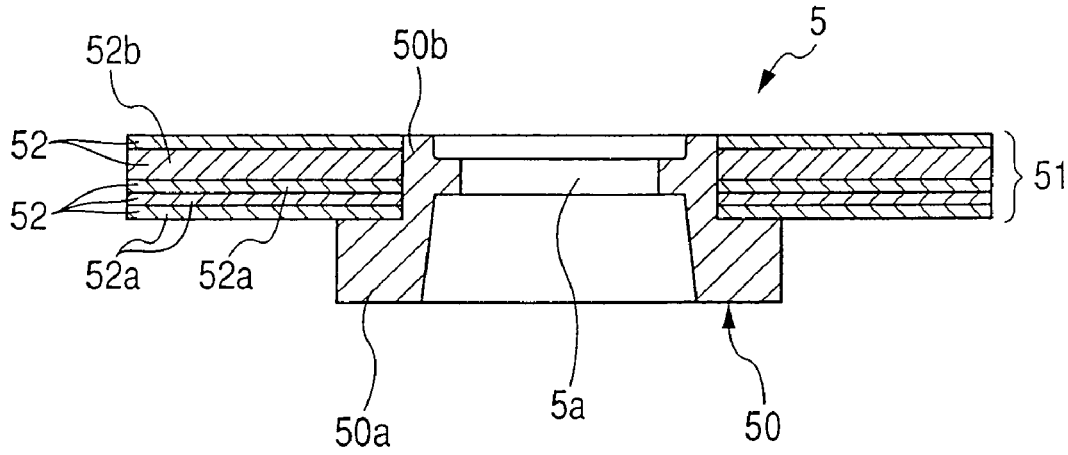
FIG. 2 is a cross-sectional view showing an example of a fixed magnetic core according to the first embodiment of the invention.
Figure 3:
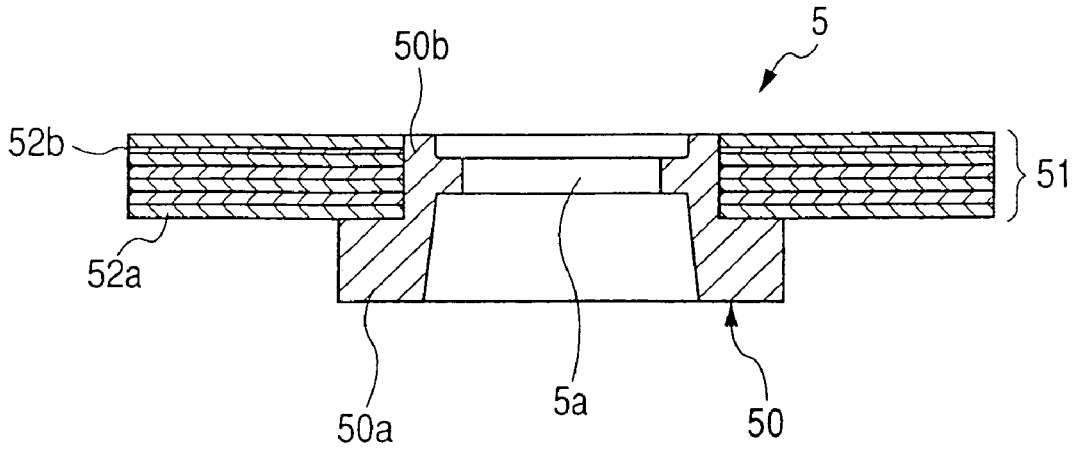
FIG. 3 is a cross-sectional view showing another example of the fixed magnetic core according to the first embodiment of the invention.

Referring now to FIG. 2, the fixed magnetic core 5 has a base portion 50 and a disc portion 51.

The base portion 50 has the center through-hole 5*a* formed through the radial center thereof. As shown in FIG. 1, the base portion 50 is so arranged in the electromagnetic switch 1 as to face the plunger 6 in the longitudinal direction of the switch 1. The disc portion 51 is fixed to the base portion 50 and has an end face part of which abuts the bobbin 8. Further, a radially outer portion of the end face of the disc portion 51 abuts an inner shoulder 3*a* formed in the yoke 3, thereby positioning the fixed magnetic core 5 in the yoke 3.

In the present embodiment, the fixed magnetic core 5 is made in two-part form. That is, the base portion 50 and the disc portion 51 are first made separately and then assembled together.

More specifically, the base portion 50 is formed to have a body 50*a* and a boss 50*b*. The body 50*a* is fitted in the bobbin 8 and faces the plunger 6 in the longitudinal direction of the electromagnetic switch 1. The boss 50*b*, which has a cylindrical shape, protrudes from the body 50 in the opposite direction to the plunger 6. On the other hand, the disc portion 51 is made by stacking a plurality of metal (e.g., steel) sheets 52. Each of the metal sheets 52 is formed, by pressing, so as to have a center through-hole formed through the radial center thereof. The base and disc portions 50 and 51 are assembled together by press-fitting the boss 50*b* of the base portion 50 into the center through-holes of the metal sheets 52 that make up the disc portion 51.

Further, in the present embodiment, the metal sheets 52 include a plurality of base metal sheets 52*a* and a balance metal sheet 52*b*.

All of the base metal sheets 52*a* have the same thickness which may be the thickness of a standard steel sheet available from the market. In comparison, the balance metal sheet 52*b* has a thickness that is predetermined to balance the difference between a desired thickness of the disc portion 51 (i.e., a desired thickness of the stack of metal sheets 52) and the sum of thickness of the base metal sheets 52*a*.

It should be noted that the terms "base metal sheets" and "balance metal sheet" are used here only for the purpose of representing the contributions of their thicknesses to the thickness of the entire disc portions 51.

It should also be noted that the thicknesses of the base metal sheets 52*a* may be different from each other. Moreover, it should also be noted that the metal sheets 52 may include more than one balance metal sheet 52*b*.

In some cases, the predetermined thickness of the balance metal sheet 52*b* may be equal to the thickness of the base metal sheet 52*a*. However, in most cases, the predetermined thickness of the balance metal sheet 52*b* would be different from the thickness of the base metal sheet 52*a*.

For example, in FIG. 1, the predetermined thickness of the balance metal sheet 52*b* is greater than the thickness of the base metal sheets 52*a*. On the contrary, in FIG. 2, the predetermined thickness of the balance metal sheet 52*b* is less than the thickness of the base metal sheets 52*a*.

With the above configuration, the thickness of the disc portion 51 can be set to the desired thickness by setting the thickness of the balance metal sheet 52*b* to the predetermined thickness that can balance the difference between the desired thickness of the disc portion 51 and the total thickness of the base metal sheets 52*a* (i.e., the sum of thickness of the base metal sheets 52*a*).

Consequently, the cross section of the disc portion 51 can be optimized with the desired thickness of the disc portion 51.

Having described the configuration of the electromagnetic switch 1 according to the present embodiment, operation thereof will be described hereafter.

When the magnetic coil 4 is energized upon turning on a starter switch (not shown), the fixed magnetic core 5 is magnetized to create a magnetic attraction. The magnetic attraction attracts the plunger 6 to move, from a stationary position thereof, toward the fixed magnetic core 5 against the urging force of the return spring 9. With the movement of the plunger 6, the shaft 7 is deeply pushed into the contact chamber 10*a*, causing the movable contact 15 to make contact with the fixed contacts 14. After that, the plunger 6 further moves toward the fixed magnetic core 5 against both the urging forces of the return spring 9 and the contact pressure spring 17, until it makes contact with the base portion 50 of the fixed magnetic core 5.

Thus, after making contact with the fixed contacts 14, the movable contact 15 keeps the contact with the fixed contacts 14 under pressure applied by the contact pressure spring 17, thereby bridging the fixed contacts 14.

Consequently, the power supply circuit of the starter motor is closed, so that the starter motor is supplied with power from the battery to start the engine of a motor vehicle.

As soon as the engine has started, the magnetic coil 4 is deenergized upon turning off the starter switch, causing the magnetic attraction between the fixed magnetic core 5 and the plunger 6 to disappear. Then, the plunger 6 is returned to the stationary position thereof by the urging force of the return spring 9. With the returning movement of the plunger 6, the shaft 7 is pulled out from the contact chamber 10*a*, leaving only the distal end thereof in the contact chamber 10*a*.

Consequently, the movable contact 15 gets away from the fixed contacts 14, so that the power supply circuit of the motor starter is opened, and thus the power supply to the starter motor is shut off.

Second Embodiment

Figure 4:
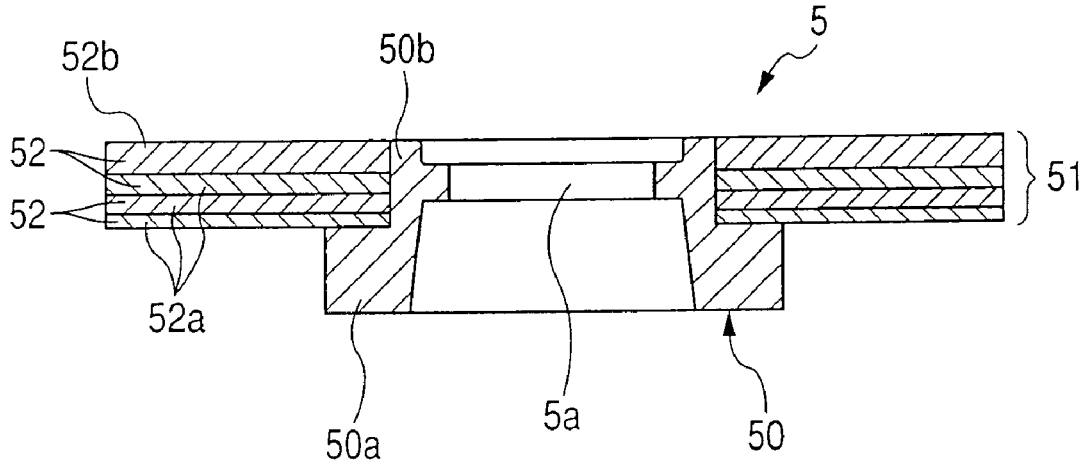
FIG. 4 is a cross-sectional view showing a fixed magnetic core according to the second embodiment of the invention.

FIG. 4 shows a fixed magnetic core 5 according to the second embodiment of the invention.

As shown in FIG. 4, in this embodiment, the thickness of the balance metal sheet 52*b* is greater than the thickness of the base metal sheets 52*a*. Further, the balance metal sheet 52*b* has been press-fitted onto the boss 50*b* of the base portion 50 at the last among the metal sheets 52. Consequently, after assembly of the electromagnetic switch 1, the balance metal sheet 52*b* is farthest from the plunger 6 among the metal sheets 52.

As described previously, when forming the disc portion 51 by staking the metal sheets 52, the press-fit load for each of the metal sheets 52 is smaller than in the case of a disc portion that is formed of a piece of thick metal sheet. Accordingly, each of the metal sheets 52 may be detached from the boss 50*b* of the base portion 50 with a smaller force. Consequently, when the plunger 6 collides against the fixed magnetic core 5 during operation of the switch 1, the metal sheets 52 may be detached from the boss 50*b* of the base portion 50.

However, in the present embodiment, the balance metal sheet 52*b* has the greater thickness than the base metal sheets 52*a*, and thus has been press-fitted onto the boss 50*b* of the base portion 50 with a greater load. Accordingly, the balance metal sheet 52*b* can be detached from the boss 50*b* of the base portion 50 only with a greater force. Consequently, it is possible to reliably prevent the balance metal sheet 52*b* and thus the entire disc portion 51 from being detached from the boss 50*b* of the base portion 50 during operation of the switch 1.

Third Embodiment

Figure 5:
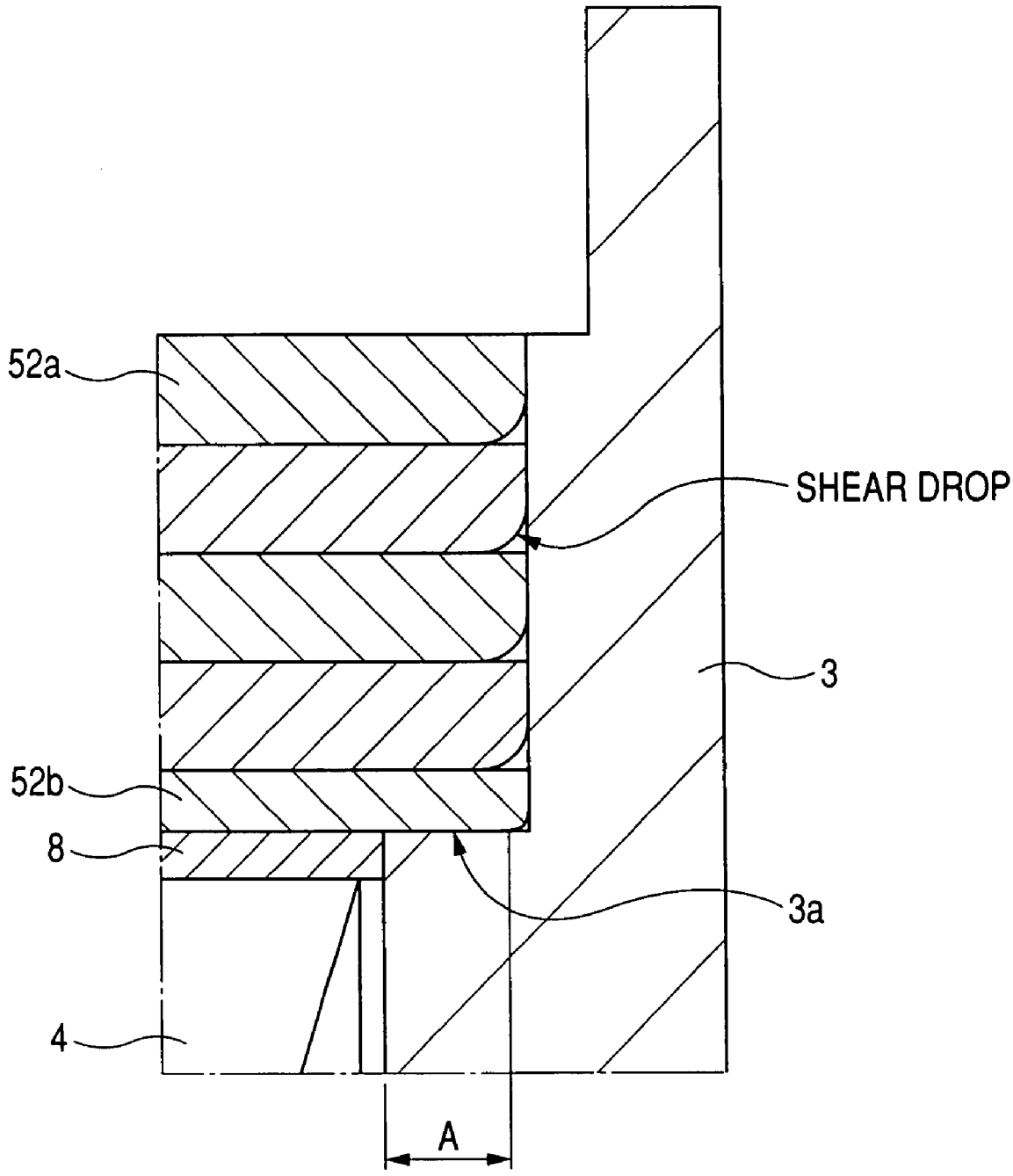
FIG. 5 is a cross-sectional view illustrating the abutment between an inner shoulder of a yoke and a disc portion of a fixed magnetic core according to the third embodiment of the invention.

Referring to FIG. 5, in this embodiment, the thickness of the balance metal sheet 52*b* is less than the thickness of the base metal sheets 52*a*. Further, the balance metal sheet 52*b* has been press-fitted onto the boss 50*b* of the base portion 50 at the first among the metal sheets 52. Consequently, after assembly of the electromagnetic switch 1, the balance metal sheet 52*b* abuts the inner shoulder 3*a* of the yoke 3.

In general, during formation of a metal sheet by pressing, shear drop may occur at edges of the metal sheet. Further, the degree of shear drop decreases with the thickness of the metal sheet.

Accordingly, in the present embodiment, the balance metal sheet 52*b*, which has the less thickness than the base metal sheets 52*a*, has been formed with a smaller degree of shear drop. Consequently, it is possible to secure a sufficiently large contact area A between the balance metal sheet 52*b* and the inner shoulder 3*a*, thereby minimizing the magneto-resistance of the magnetic circuit of the electromagnetic switch 1. As a result, the magnetic attraction between the fixed magnetic core 5 and the plunger 6 can be maximized, thus making it possible to downsize the electromagnetic switch 1.

While the above particular embodiments of the invention have been shown and described, it will be understood by those who practice the invention and those skilled in the art that various modifications, changes, and improvements may be made to the invention without departing from the spirit of the disclosed concept.

Figure 6:
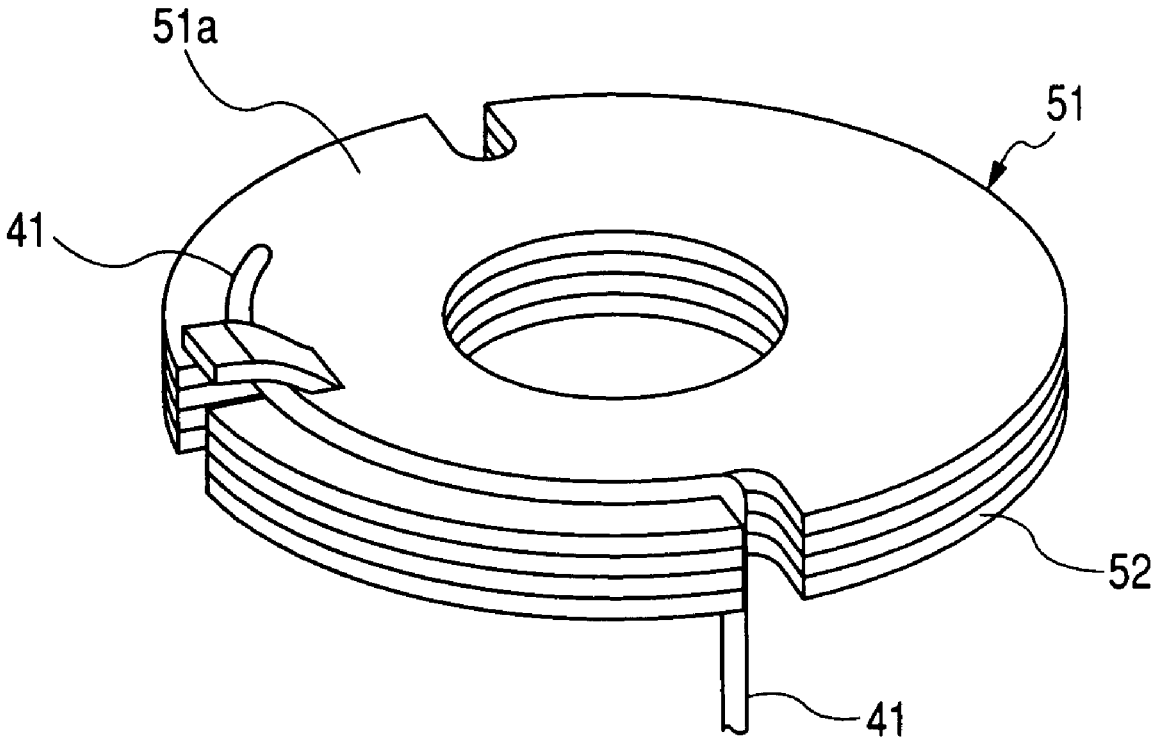
FIG. 6 is a perspective view illustrating a variation of the electromagnetic switch.
Figure 7:
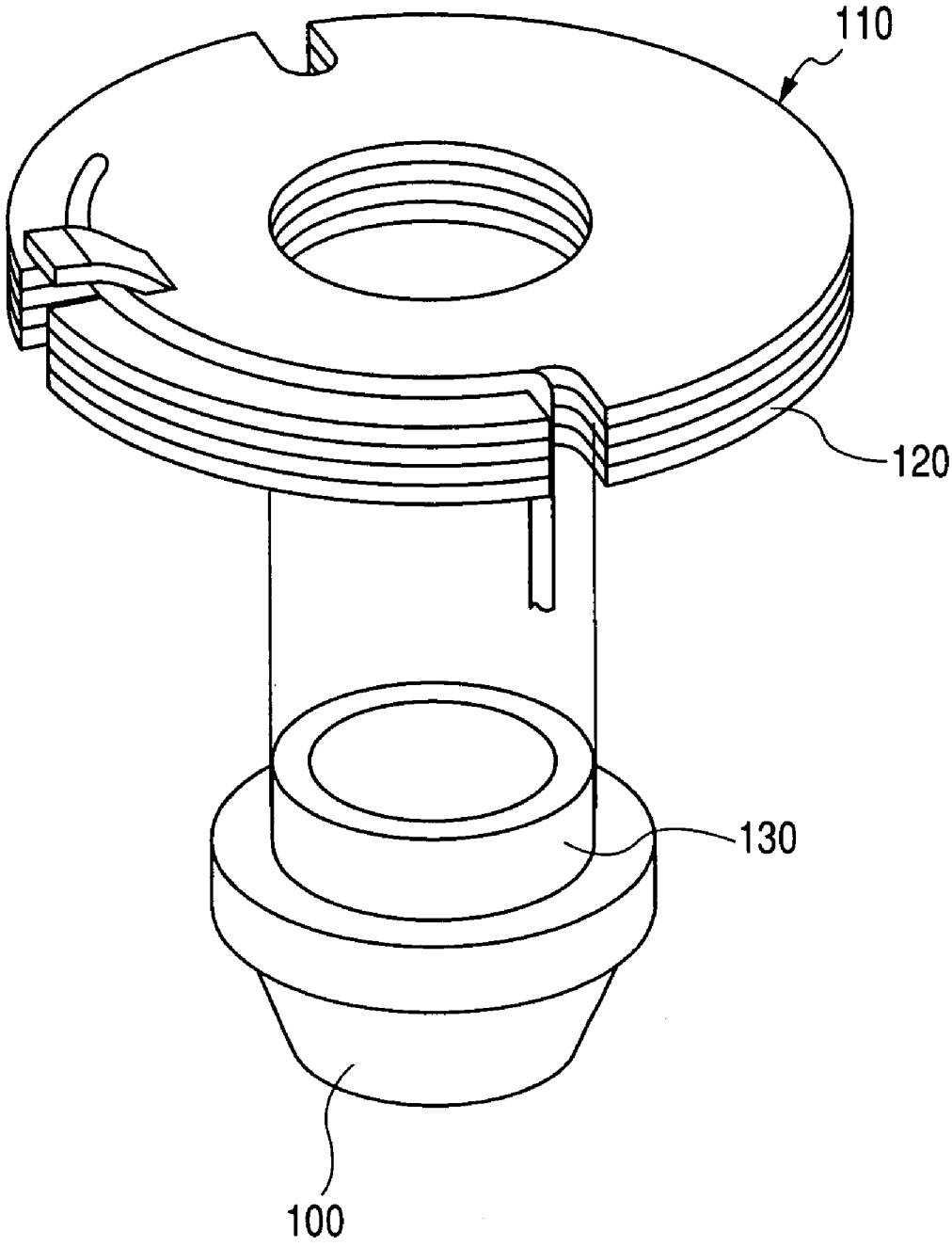
FIG. 7 (PRIOR ART)
FIG. 7 is an exploded perspective view showing a fixed magnetic core of a prior art electromagnetic switch.

For example, in the above-described electromagnetic switch 1, an earth terminal 41 of the magnetic coil 4 (i.e., the distal end of the hold winding 4*b*) may be drawn to the end face 51*a* of the disc portion 51 on the opposite side to the plunger 6, and joined to the end face 51*a* by welding or soldering, as shown in FIG. 6.

In this case, the one of the metal sheets 52, which is arranged most outside (i.e., farthest from the plunger 6) among the metal sheets 52, is preferably made of steel and preferably have a coated surface on the opposite side to the plunger 6.

Thus, the earth terminal 41 of the magnetic coil 4 can be reliably joined to the coated surface of the steel-made metal sheet 52. At the same, since there is no need to coat all of the metal sheets 52, the manufacturing cost can be reduced.

Such modifications, changes, and improvements within the skill of the art are intended to be covered by the appended claims.

What is claimed is:

1. An electromagnetic switch comprising:

a pair of fixed contacts;

a movable magnetic core configured to be moved by a magnetic attraction, thereby establishing an electrical connection between the fixed contacts;

a magnetic coil; and a fixed magnetic core configured to create the magnetic attraction when the magnetic coil is energized, the fixed magnetic core having a base portion and a disc portion, the base portion being arranged to face the movable magnetic core, the disc portion being fixed to the base portion, the disc portion being formed of a stack of at least one base metal sheet and a balance metal sheet, the balance metal sheet having a thickness that is predetermined to balance a difference between a desired thickness of the disc portion and a total thickness of the at least one base metal sheet, wherein the thickness of the balance metal sheet is predetermined to balance the difference between the desired thickness of the disc portion and the total thickness of the at least one base metal sheet, and is different from the thickness of the at least one base metal sheet, and the thickness of the balance metal sheet is one of greater than the thickness of the at least one base metal sheet and less than the thickness of the at least one base metal sheet.

2. The electromagnetic switch as set forth in claim 1, wherein the base portion of the fixed magnetic core has a body facing the movable magnetic core and a boss protruding from the body in an opposite direction to the movable magnetic core, each of the base and balance metal sheets has a center through-hole in which the boss of the base portion is press-fitted, the balance metal sheet is arranged farthest from the movable magnetic core among the metal sheets, and the thickness of the balance metal sheet is greater than the thickness of the at least one base metal sheet.

3. The electromagnetic switch as set forth in claim 1, further comprising a yoke that accommodates therein the magnetic coil and the fixed magnetic core and has formed therein an inner shoulder by which the fixed magnetic core is positioned in the yoke, wherein, among the metal sheets, only the balance metal sheet abuts the inner shoulder of the yoke, and the thickness of the balance metal sheet is less than the thickness of the base metal sheet.

4. The electromagnetic switch as set forth in claim 1, wherein one of the metal sheets, which is arranged farthest from the movable magnetic core among the metal sheets, is made of steel and has, on an opposite side to the movable magnetic core, a coated surface to which an earth terminal of the magnetic coil is joined by one of welding and soldering.

* * * * *